US009810390B2

(12) United States Patent
Hagedorn et al.

(10) Patent No.: US 9,810,390 B2
(45) Date of Patent: Nov. 7, 2017

(54) OPTICAL SURFACE AND LIGHTING DEVICE FOR VEHICLES

(71) Applicant: Hella KGaA Hueck & Co., Lippstadt (DE)

(72) Inventors: Susanne Hagedorn, Lippstadt (DE); Andreas Stockfisch, Lippstadt (DE); Klaus Streich-Schulz, Lippstadt (DE)

(73) Assignee: Hella KGaA Hueck & Co., Lippstadt (DE)

( * ) Notice: Subject to any disclaimer, the term of this patent is extended or adjusted under 35 U.S.C. 154(b) by 0 days.

(21) Appl. No.: 14/420,882

(22) PCT Filed: Aug. 14, 2013

(86) PCT No.: PCT/EP2013/066980
§ 371 (c)(1),
(2) Date: Feb. 10, 2015

(87) PCT Pub. No.: WO2014/027020
PCT Pub. Date: Feb. 20, 2014

(65) Prior Publication Data

US 2015/0219299 A1 Aug. 6, 2015

(30) Foreign Application Priority Data

Aug. 14, 2012 (DE) ..... 10 2012 107 427

(51) Int. Cl.
*F21S 8/10* (2006.01)
*F21V 13/04* (2006.01)
*F21V 5/00* (2015.01)

(52) U.S. Cl.
CPC ..... *F21S 48/125* (2013.01); *F21S 48/1283* (2013.01); *F21V 5/004* (2013.01); *F21V 13/04* (2013.01)

(58) Field of Classification Search
CPC .. F21S 48/125; F21S 48/1258; F21S 48/1283; F21V 5/002; F21V 5/004; F21V 5/005; F21V 13/04
(Continued)

(56) References Cited

U.S. PATENT DOCUMENTS 1,601,688 A 9/1926 Nystrom
3,743,385 A * 7/1973 Schaefer ..... F21S 48/1258 359/718
(Continued)

FOREIGN PATENT DOCUMENTS

DE 19814478 A1 1/1999
DE 102008023551 A1 11/2009
(Continued)

OTHER PUBLICATIONS

Patent Translate Powered by EPO and Google, "Description DE102008023551", Original publication date Nov. 19, 2009, pp. 1-10.*

*Primary Examiner* — Alan Cariaso
(74) *Attorney, Agent, or Firm* — Husch Blackwell LLP

(57) ABSTRACT

An optical surface for softening a light/dark border of a lighting device for vehicles, having a grid of lens elements distributed over a base surface, by means of which a light bundle passing through the optical surface can be diffused in relation to a main direction, wherein the lens elements are each designed as micro-lens elements, which, on one hand, exhibit a central main emission surface, which follows a contour of the base surface, by means of which the light beams of the light bundle are deflected in a main direction corresponding to the contour of the base surface, and on the other hand, exhibit subsidiary emission surfaces, running at an angle to the central main emission surface, by means of
(Continued)

which light beams of the light bundle are diffused in a diffusion direction in relation to the main direction.

9 Claims, 1 Drawing Sheet

(58) Field of Classification Search
USPC ..... 362/520, 521, 522, 338; 3/520, 521, 522
See application file for complete search history.

(56) References Cited

U.S. PATENT DOCUMENTS

| | | | | |
|---|---|---|---|---|
| 4,935,665 | A * | 6/1990 | Murata | F21S 48/1394 257/E25.02 |
| 6,019,492 | A * | 2/2000 | Ikegaya | B60Q 1/2607 362/308 |
| 6,139,173 | A * | 10/2000 | Hanamori | F21S 48/2212 362/309 |
| 6,220,736 | B1 * | 4/2001 | Dobler | F21S 48/1233 359/742 |
| 6,352,359 | B1 | 3/2002 | Shie et al. | |
| 7,114,838 | B2 * | 10/2006 | Wu | F21V 5/04 257/E33.059 |
| 8,066,402 | B2 * | 11/2011 | Klipstein | B60Q 3/065 362/202 |
| 8,405,105 | B2 * | 3/2013 | Chiang | F21V 5/007 257/88 |

FOREIGN PATENT DOCUMENTS

| | | | |
|---|---|---|---|
| DE | 102009020593 | A1 | 11/2010 |
| FR | 2770617 | A1 | 5/1999 |

* cited by examiner

OPTICAL SURFACE AND LIGHTING DEVICE FOR VEHICLES

CROSS REFERENCE

This application claims priority to PCT/EP2013/066980, filed Aug. 14, 2013, which itself claims priority to German Application No. 10 2012 107427.5, filed Aug. 14, 2012, which are both hereby incorporated by reference.

FIELD OF TECHNOLOGY

The invention relates to an optical surface for softening a light/dark border of a lighting device for vehicles, having a grid of lens elements distributed over a base surface, by means of which a light bundle passing through the optical surface can be diffused in relation to a main direction.

Furthermore, the invention relates to a lighting device for vehicles.

BACKGROUND

Optical surfaces for softening a light/dark border of a lighting device for vehicles are known from DE 10 2008 023 551 A1, which are provided with a grid of lens elements distributed on a base surface thereof. The lens elements completely cover the base surface of the optical surface designed as a lens surface. The contour of the lens elements is calculated according to a mathematical function, from powers of angular functions, for example. As a result, it should be possible to obtain a targeted adjustment of the properties of the light/dark border in a light distribution from motor vehicle lighting devices. In particular, it should be possible to adjust the degree of softening of the light/dark border in a targeted manner. The disadvantage with the known optical surface is that the production expenditures for the shaping of the optical surface according to the mathematical functions are relatively high.

SUMMARY OF THE INVENTION

The object of the present invention is to further develop an optical surface, or a lighting device, respectively, such that a targeted diffusion of light beams in relation to a main direction is ensured in a simple manner.

In order to achieve the object, lens elements are each designed as micro-lens elements, which, on one hand, have a central main emission surface that follows a contour of the base surface, by means of which light beams of the light bundle are deflected in the main direction corresponding to the contour of the base surface, and having, on the other hand, a subsidiary emission surface running at an angle to the central main emission surface, by means of which light beams of the light bundle are diffused in a diffusion direction in relation to the main direction.

The invention enables a targeted diffusion of light beams in relation to a main direction by means of micro-lens elements disposed in a distributed manner. The main direction of the light beams is defined by the contour of a base surface of the optical surface, on which a plurality of micro-lens elements is disposed. A central main emission surface of the micro-lens elements follows the contour of the base surface of the optical surface, such that light beams passing through this main emission surface are deflected in the main direction, as they would be if the optical surface were provided with no micro-lens elements in this region. Only a subsidiary emission surface of the respective micro-lens elements causes a diffusion of the light beams in relation to the main direction provided per se, such that, as a result, a softening, for example, of the light/dark border in the light devices for vehicles can occur. Alternatively, these optical surfaces can also be used to align light distributions from two light modules in a lighting device. Alternatively, the diffusion of the light beams via the subsidiary emission surface can also be used to illuminate traffic signs mounted above the roadway (overhead signs: OHS).

According to a preferred embodiment of the invention, the subsidiary emission surface of the micro-lens elements is formed by an angled surface, which bends away from the main emission surface toward the base surface of the optical surface at a predefined angle. The micro-lens elements can be designed such that they are dish-shaped and/or have a trapezoidal (equilateral trapezoid) cross-section. The degree of diffusion, or the spreading from an original light beam, respectively, occurs solely through the predefining of the spacing of the main emission surface to the base surface, and the angle at which the subsidiary emission surface adjoins the central main emission surface. The micro-lens elements thus have a simple geometric shape, wherein the degree of diffusion can be controlled additionally by the number of micro-lens elements distributed over the base surface of the optical surface.

According to a further development of the invention, the micro-lens elements form a boundary surface to the optical surface. Advantageously, the micro-lens elements are relatively small as a result, such that they are not visible to an observer from the exterior. The optical surface thus has a homogenous appearance, fulfilling the current design requirements.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

The invention relates to optical surfaces that can be used, for example, as lens surfaces in lighting devices for vehicles. The light device for vehicles can, for example, be designed as a headlamp having a projection module. This projection module has a light source, a reflector, a lens, and an aperture disposed between the reflector and the lens. The aperture has an aperture edge, which serves to project a light/dark border in an asymmetrical low beam light distribution, for example. The lens is disposed in the main beam direction in front of the reflector and the aperture. The lens can exhibit a flat light entry surface and a convex light exit surface.

Figure 1:
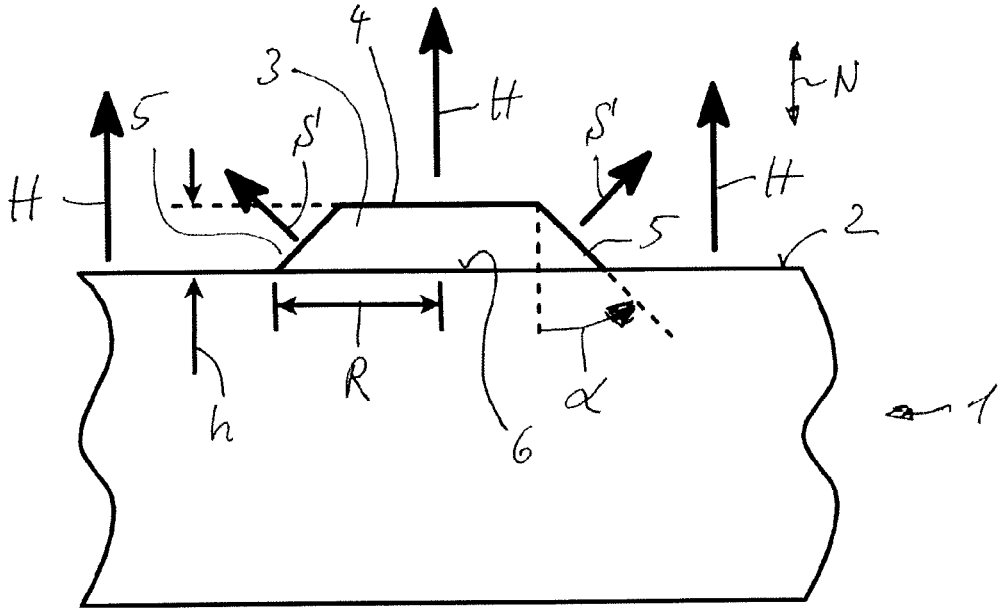
FIG. 1 is a schematic partial view of an optical surface having a micro-lens element.

An optical surface 1 is schematically depicted in FIG. 1, which can form, for example, a portion of the light entry surface or the light exit surface of the lens. As a result, it can serve, for example, to soften the light/dark border, or, respectively, for a targeted adjustment of the sharpness, or the course of the gradient, respectively, of the light/dark border. Alternatively, this optical surface 1 can also serve to illuminate overhead traffic signs.

A portion of the optical surface 1 is depicted in FIG. 1, wherein a dish-shaped micro-lens element 3 is formed on a base surface 2 of the optical surface 1. The micro-lens element 3 has a central main emission surface 4 and an annular subsidiary emission surface 5 adjoining it. The central main emission surface 4 has a contour, corresponding to a contour of the base surface 2 displaced in the normal direction N. The central main emission surface 4, which can be designed, for example, as a flat plateau, is thus disposed, displaced parallel to the base surface 2 of the optical surface 1 disposed in the region of the micro-lens elements 3. When the base surface 2 is curved in this region, then the central main emission surface 4 is likewise curved to the same, or nearly the same, extent. When the base surface 2 is flat in this region—as in FIG. 1—the central main emission surface 4 is likewise flat. The central main emission surface 4 thus runs in a direction nearly identical to, or following the contour of the base surface 2 of the optical surface 1 in the region of these micro-lens elements 3. The light passing through the central main emission surface 4 is thus deflected in the main direction H to the same extent that it is deflected by the base surface 2 of the optical surface 1 in the main direction H when there are no micro-lens elements 3. If the contour of the base surface 2 is flat in the region of the micro-lens elements 3—as depicted in FIG. 1—the light is emitted in the main direction H by the central main emission surface 4, as well as by the base surface 2 disposed adjacent to the micro-lens element 3.

A diffusion of the light in relation to the main direction H in the diffusion direction S is caused by the subsidiary emission surface 5, designed as an angled surface, which adjoins the central main emission surface 4, preferably aligned therewith, at an angle α, and extends as far as the base surface 2 of the optical surface 1.

The micro-lens element 3 is defined by a spacing h of the central main emission surface 4 to the base surface 3, as well as by the angle α, at which the subsidiary emission surface 5 adjoins the central main emission surface 4 in the direction of the base surface 2. When these parameters are defined, a radius R for a boundary surface 6 of the micro-lens element 3 in relation to the base surface 2 of the optical surface 1 is obtained, depending on a curvature of the main emission surface 4. The spacing h between the central main emission surface 4 and the base surface 2 can lie in a range of 0.001 mm to 0.15 mm. The angle cc can lie in a range of 70° to 89.9°. A first example of the dimensions for the micro-lens elements 3, which are disposed in an arbitrary grid on a light exit side of the optical surface 1 designed as a lens, is given below:

| Parameter | from | to | particularly advantageous here |
|---|---|---|---|
| α/° | 89 | 89.9 | 89.35 |
| H/mm | 0.001 | 0.01 | 0.003 |
| R/mm | <2 | | 0.35 |

Alternatively, the micro-lens elements 3 can also be disposed in the manner of a grid, preferably distributed evenly on a light entry side or light exit side of the optical surface 1 designed as a lens, with the following parameters:

| Parameter | from | to | particularly advantageous here |
|---|---|---|---|
| α/° | 74 | 85 | 80 |
| H/mm | 0.010 | 0.15 | 0.1 |
| R/mm | <2 | | 0.9 |

Figure 2:
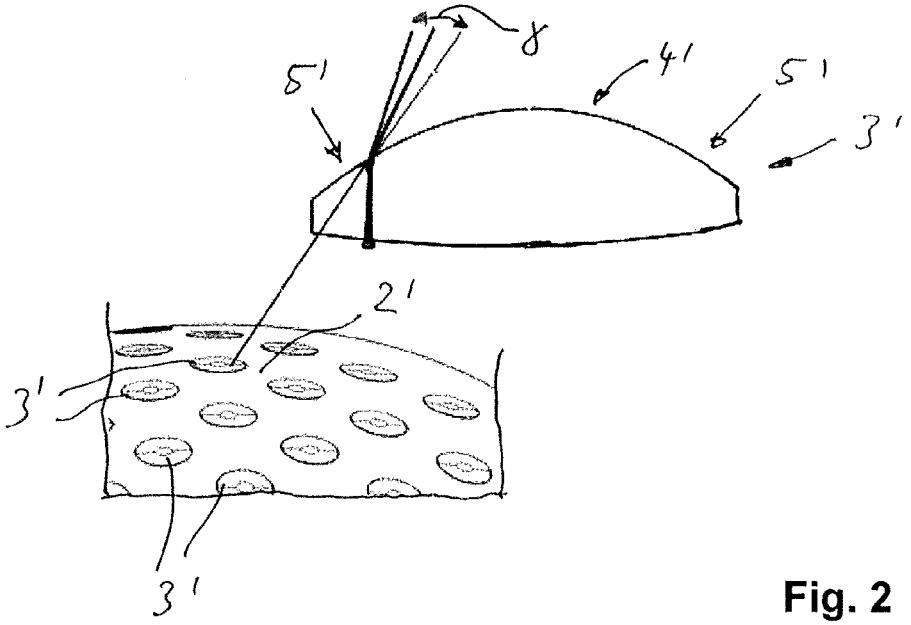
FIG. 2 is a perspective partial view of an optical surface having micro-lens elements distributed thereon.

In FIG. 2, numerous identical micro-lens elements 3' are depicted, distributed evenly on the optical surface 1, wherein, by way of example, an enlargement of one of the micro-lens elements 3' is depicted in cross-section. From this it is visible that a central main emission surface 4' of the micro-lens element 3' is curved to nearly, or exactly, the same extent as the base surface 2' of the optical surface 1'. A subsidiary emission surface 5' adjoins the central main emission surface 4' in a continuous manner, and enables a spreading of the light beams at an angle γ. The micro-lens element 3' is designed as a lens in this embodiment.

It is to be understood that the base surface 2, 2' of the optical surface 1, 1' can be designed to be flat and/or convex, or conforming to a freeform surface.

The micro-lens elements 3, 3' are preferably evenly distributed over the entire base surface 2, 2' of the optical surface 1, or in only a portion of the base surface 2, 2' of the optical surface 1. The course of the gradient of the light in the light/dark border, for example, can be controlled by the number and/or the size of the micro-lens elements 3, 3' in relation to the base surface 2, 2' of the optical surface 1.

The optical surface 1 can be made of glass or plastic materials, and is designed such that it is transparent.

LIST OF REFERENCE SYMBOLS

1, 1' optical surface
2, 2' base surface
3, 3' micro-lens elements
4, 4' central main emission surface
5, 5' subsidiary emission surface
6 boundary surface
h spacing
H main direction
S diffusion direction
N normal direction
R radius
α angle

The invention claimed is:

1. An optical surface for softening a light/dark border of a lighting device for vehicles comprising:

a grid of lens elements distributed over a base surface, by means of which a light bundle passing through the optical surface can be diffused in relation to a main direction, wherein the lens elements are each designed as micro-lens elements, which have a central main emission surface following a contour of the base surface, by means of which light beams of the light bundle are deflected in a manner corresponding to the contour of the base surface in the main direction, and which has a subsidiary emission surface outwardly projecting from the base surface running at an angle to the central main emission surface, by means of which light beams of the light bundle are diffused in relation to the main direction in a diffusion direction, wherein the micro-lens elements are each designed in the shape of a dish at the central main emission surface, and wherein the central main emission surface of each micro-lens element is flat.

2. The optical surface according to claim 1, wherein the central main emission surface has substantially the same contour as the contour of the base surface of the optical surface running in a normal direction, displaced parallel thereto.

3. The optical surface according to claim 1 wherein the central main emission surface exhibits a spacing to the base surface of the optical surface in a range of 0.001 mm to 0.15 mm.

4. The optical surface according to claim 1 wherein the subsidiary emission surface runs at an angle, in a range of 74° to 89.9°, from the central main emission surface toward the base surface with respect to the central main emission surface.

5. The optical surface according to claim 1 wherein the micro-lens elements are disposed at a spacing to one another, wherein the base surface of the optical surface extends between the micro-lens elements.

6. The optical surface according to claim 1 wherein the base surface of the optical surface is designed such that it is at least one of flat and/or convex, or corresponds to freeform surface.

7. The optical surface according to claim 1 wherein the micro-lens elements form a boundary surface with the base surface of the optical surface.

8. An optical surface for softening a light/dark border of a lighting device for vehicles comprising:

a grid of lens elements distributed over a base surface, by means of which a light bundle passing through the optical surface can be diffused in relation to a main direction, wherein the lens elements are each designed as micro-lens elements, which have a central main emission surface following a contour of the base surface, by means of which light beams of the light bundle are deflected in a manner corresponding to the contour of the base surface in the main direction, and which has a subsidiary emission surface including opposing straight first portions extending perpendicularly upwardly from the base surface and a second curved portion adjoining the central main emission surface in a continuous manner, by means of which light beams of the light bundle are diffused in relation to the main direction in a diffusion direction, wherein the micro-lens elements are each designed in the shape of a dish at the central main emission surface, and wherein the central main emission surface of each micro-lens element is domed.

9. An optical surface for softening a light/dark border of a lighting device for vehicles comprising:

a grid of lens elements distributed over a base surface, by means of which a light bundle passing through the optical surface can be diffused in relation to a main direction, wherein the lens elements are each designed as micro-lens elements, which have a central main emission surface following a contour of the base surface, by means of which light beams of the light bundle are deflected in a manner corresponding to the contour of the base surface in the main direction, and which has a subsidiary emission surface outwardly projecting from the base surface running at an angle to the central main emission surface, by means of which light beams of the light bundle are diffused in relation to the main direction in a diffusion direction, wherein the micro-lens elements are each designed in the shape of a dish at the central main emission surface, wherein the central main emission surface of each micro-lens element is flat or domed, wherein the central main emission surface exhibits a spacing to the base surface of the optical surface in a range of 0.001 mm to 0.15 mm, and wherein the subsidiary emission surface runs at an angle, in a range of 74° to 89.9°, from the central main emission surface toward the base surface with respect to the central main emission surface.

* * * * *